US011773563B2

(12) United States Patent
Thomas et al.

(10) Patent No.: US 11,773,563 B2
(45) Date of Patent: Oct. 3, 2023

(54) DIPPER HANDLE

(71) Applicant: Caterpillar Global Mining LLC, Tucson, AZ (US)

(72) Inventors: Adam J. Thomas, Cedarburg, WI (US); Michael W. Haws, Wind Point, WI (US); Aruna Kinjarapu, Oro Valley, AZ (US); Cristian Zaharia, Marana, AZ (US); Vladimir A. Korchagin, Tucson, AZ (US)

(73) Assignee: Caterpillar Global Mining LLC, Tucson, AZ (US)

( * ) Notice: Subject to any disclaimer, the term of this patent is extended or adjusted under 35 U.S.C. 154(b) by 219 days.

(21) Appl. No.: 17/406,533

(22) Filed: Aug. 19, 2021

(65) Prior Publication Data

US 2023/0056316 A1 Feb. 23, 2023

(51) Int. Cl.
*E02F 3/36* (2006.01)
*E02F 3/30* (2006.01)

(52) U.S. Cl.
CPC ..... *E02F 3/3668* (2013.01); *E02F 3/308* (2013.01)

(58) Field of Classification Search
CPC ..... E02F 3/308; E02F 3/3668
See application file for complete search history.

(56) References Cited

U.S. PATENT DOCUMENTS

| | | | | |
|---|---|---|---|---|
| 1,974,458 | A | 9/1934 | Hallquist | |
| 2,443,537 | A | 6/1948 | Hilgeman | |
| 6,536,652 | B2 | 3/2003 | Sasaki et al. | |
| 10,865,541 | B1 * | 12/2020 | Rhodine | E02F 3/38 |
| 10,981,253 | B2 | 4/2021 | Griffith et al. | |
| 2003/0126772 | A1 | 7/2003 | Masumoto | |
| 2018/0021890 | A1 | 1/2018 | Griffith et al. | |
| 2021/0095436 | A1 * | 4/2021 | Rhodine | E02F 3/427 |

FOREIGN PATENT DOCUMENTS

| | | | |
|---|---|---|---|
| EP | 2050881 | B1 | 7/2017 |
| JP | 2005213819 | A | 8/2005 |
| WO | 2018122468 | A1 | 7/2018 |

OTHER PUBLICATIONS

Examination Report for Int'l. Patent Appln. No. 2021218210, dated Aug. 15, 2022 (5 pgs).

* cited by examiner

*Primary Examiner* — Saul Rodriguez
*Assistant Examiner* — Brendan P Tighe

(57) ABSTRACT

A dipper handle includes a dipper tube, a dipper engagement member, and an intermediate member between the dipper tube and the dipper engagement member. The dipper tube has a substantially cylindrical outer surface and a contoured inner surface. The contoured inner surface results in multiple wall thicknesses for the dipper tube, including a first thickness proximate a first end and a second, larger thickness, proximate a second end. The second end is configured for coupling to the intermediate member.

20 Claims, 6 Drawing Sheets

DIPPER HANDLE

TECHNICAL FIELD

This disclosure relates generally to industrial machines, and, more specifically, to an improved dipper handle for an electric rope shovel or a power shovel with improved life expectancy and wear characteristics.

BACKGROUND

Industrial machines, such as electric rope or power shovels, draglines, etc., are used to execute digging operations to remove material from, for example, a bank of a mine. An operator controls a rope shovel during a dig operation or phase to load a dipper with materials. The operator deposits the materials in the dipper into a hopper or a truck during a truck loading or truck spotting phase. After unloading the materials, the dig cycle continues, and the operator swings the dipper back to the bank to perform additional digging during a return to tuck phase.

Dippers are extremely robust and are intended to handle heavy loads. Moreover, because the dipper is intended to be supported at positions off the ground and spaced from a main body of the rope shovel, e.g., during hoist, crowd control, and swing operations, the weight of the dipper generates large loads. For example, the boom, hoist cables, and dipper handle can all experience large stresses from the dipper and its contents, particularly during digging operations. In some conventional power shovel arrangements, fatigue cracking is particularly problematic on the dipper handle, including at transitional sections of the dipper handle.

Example implementations of the present disclosure are directed toward overcoming the deficiencies described above. For instance, aspects of the present disclosure are directed to improved dipper handles with improved life expectancy and reduced fatiguing.

SUMMARY

In an aspect of the present disclosure, a dipper handle includes a dipper engagement member configured to selectively couple to a dipper; a dipper tube comprising a sidewall extending between a first end of the dipper tube and a second end of the dipper tube, the sidewall of the dipper tube having a first thickness proximate the first end of the dipper tube and having a second thickness, greater than the first thickness, proximate the second end of the dipper tube; and an intermediate member disposed between the dipper engagement member and the dipper tube, a first end of the intermediate member being configured for securement to the second end of the dipper tube.

In another aspect of this disclosure, an industrial machine includes: a base; a boom extending from the base; a crowd control mechanism movable between a retracted position and an extended position; a dipper handle coupled to the crowd control mechanism and movable by the crowd control mechanism, the dipper handle comprising: a dipper tube comprising a sidewall extending along an axial length between a first end of the dipper tube and a second end of the dipper tube, the sidewall of the dipper tube having a first thickness along a first portion of the axial length proximate the first end of the dipper tube and having a second thickness, great than the first thickness, along a second portion of the axial length proximate the second end of the dipper tube, an intermediate member coupled to the second end of the dipper tube, and a dipper engagement member coupled to the intermediate member; and a dipper attached to the dipper engagement member.

In yet another aspect of this disclosure, a dipper handle includes: a dipper tube having a substantially cylindrical outer dipper tube surface and a contoured inner dipper tube surface spaced from the outer dipper tube surface by a first thickness proximate a first end of the dipper tube and by a second thickness, greater than the first thickness, proximate a second end of the dipper tube; an intermediate member having a first intermediate member end fixed to the second end of the dipper tube; and a dipper engagement member coupled to the intermediate member and configured to couple to a dipper.

DETAILED DESCRIPTION

This disclosure generally relates to industrial machines, such as mining shovels. Mining shovels like those described herein can be used to move large amounts of material, for example, during mining operations. The improvements and techniques described herein can result in improved life for a dipper handle used with such machines as well as reduced downtime for the machine. Wherever possible, the same reference numbers will be used through the drawings to refer to the same or like features.

Figure 1:
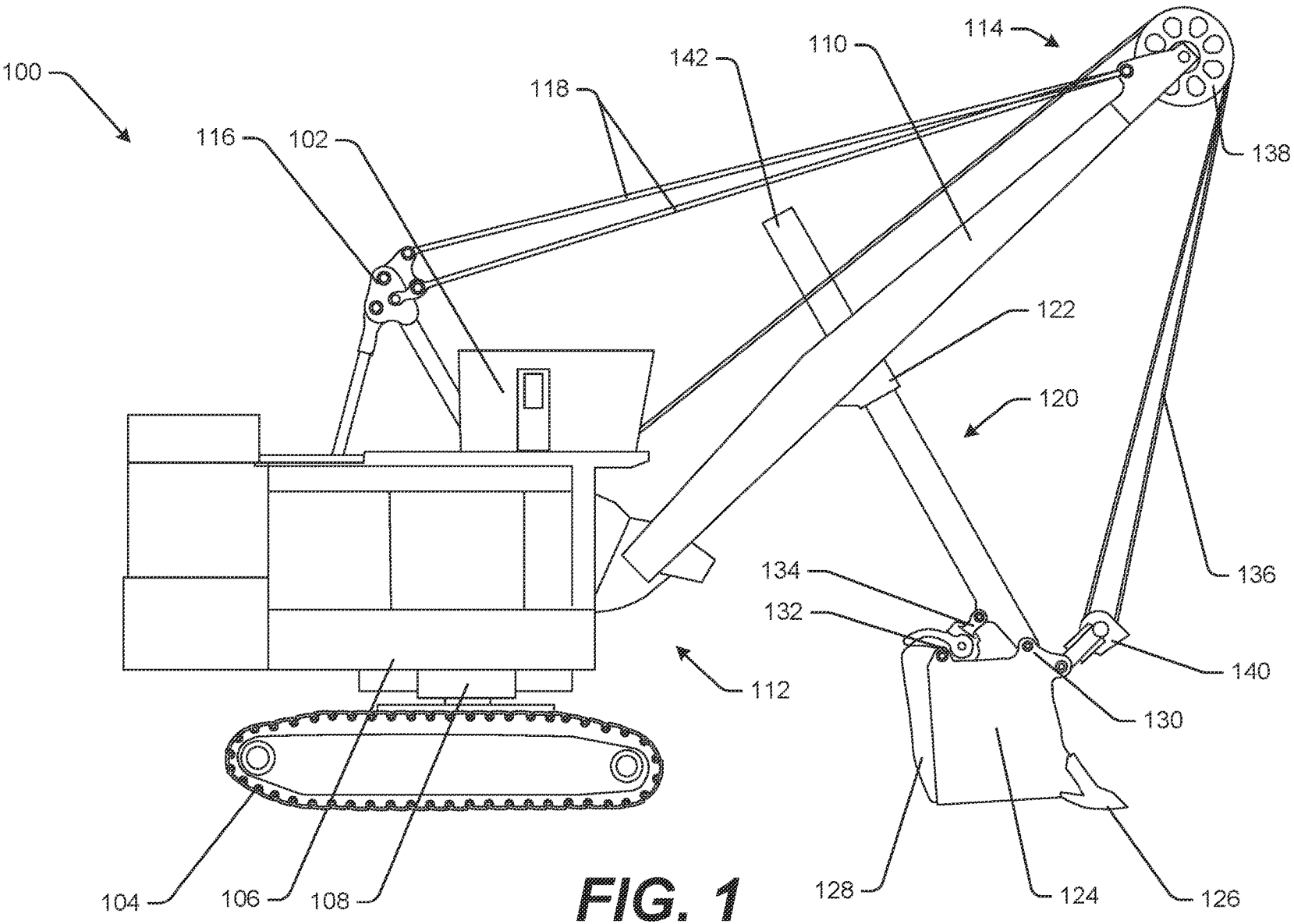
FIG. 1 is a side view of an industrial machine, in accordance with an example of the present disclosure.

Referring to FIG. 1, an industrial machine 100, embodied as a mining shovel, includes a cabin 102 configured to house one or more operators and a track 104 configured to move the machine 100 in an environment. The cabin 102 is disposed on or otherwise supported by a chassis 106 of the industrial machine 100. Moreover, the chassis 106 is disposed on a turntable 108. The turntable 108 facilitates rotational movement of the chassis 106, and therefore the cabin 102, relative to the track 104. The cabin 102 and the track 104 are shown for illustration only; the industrial machine 100 may include other styles or types of cabins and/or motive features; for example, multiple tracks 104 may be provided. Moreover, in this disclosure, the term "chassis" is generally used to refer to a rigid base, body, component, or components to which other aspects of the industrial machine 100, e.g., the cabin 102, are coupled, secured, or otherwise affixed. For instance, the chassis 106 may include a number of beams, weldments, or other components forming a rigid frame on which the cabin 102 is fixed.

As also illustrated in FIG. 1, the industrial machine 100 includes a boom 110. The boom 110 is secured proximate a first end 112 to the chassis 106 and extends to a second end 114 spaced from the cabin 102. The industrial machine 100 also includes a frame 116 extending above the chassis 106. Cables 118 extend between the frame 116 and the second end 114 of the boom 110, such that the frame 116 at least partially supports the boom 110. In the example of FIG. 1 the frame 116 is illustrated as an A-frame and the cables 118 are illustrated as including two cables. However, the frame 116 may have a different configuration and/or more or fewer cables may be used to support the boom 110. In some alternative configurations, support members in addition to or instead of the frame 116 and/or the cables 118 may be used to support the boom 110.

A dipper handle 120 is slidably secured to the boom 110. For example, FIG. 1 shows a portion of a saddle block 122 mounted to the boom 110. As will be appreciated by those having ordinary skill in the art, the saddle block 122 is secured to the boom 110 in a manner that facilitates pivoting of the saddle block 122 relative to the boom 110. Specifically, the saddle block 122 pivots about an axis normal to the plane of the perspective of FIG. 1, e.g., via a yoke or other configuration. As is conventional, the saddle block 122 is configured to slidably receive the handle 120, and the saddle block 122 may also include one or more additional support structures and/or features for supporting the dipper handle 120. In aspects of this disclosure, the dipper handle 120 is improved over conventional dipper handle assemblies. For example, the dipper handle 120 provides increased resistance to wear. Details of the dipper handle 120 are described in more detail below in connection with FIGS. 2-5.

A dipper 124 is mounted to the dipper handle 120. As is known in the art, the dipper 124 is configured to shovel materials, e.g., during mining operations. A leading edge of the dipper can include teeth 126 and/or other wear parts that facilitate digging of material. As also illustrated, a bottom 128 of the dipper 124 may be pivotable relative to a remainder of the dipper 124, e.g., to facilitate emptying materials from the dipper 124, as is known in the art. As detailed further below, the dipper 124 may include one or more attachment features that facilitate operable coupling of the dipper 124 to the dipper handle 120. For instance, FIG. 1 illustrates the dipper 124 as including a number of mounting surfaces, linkages, openings, and other features for attaching the dipper 124 to the dipper handle 120. As specifically pertains to the present disclosure (and as discussed further below), the dipper 124 includes a first mounting structure 130, e.g., proximate an open portion of the dipper 124, that facilitates a direct coupling of the dipper handle 120. The dipper 124 also includes a second mounting structure 132, e.g., proximate the bottom 128 of the dipper 124. A linkage 134 is coupled to and extends between the dipper handle 120 and the second mounting structure 132. The first mounting structure 130 and the second mounting structure 132 can include one or more axially-aligned openings that facilitate reception of a pin, e.g., to provide a pivoting relation of the respective mounting structures 130, 132 with attached features.

As also shown in FIG. 1, the machine 100 also includes a hoist cable 136 that is controllable to selectively raise and lower the dipper 124. More specifically, a first end of a hoist cable 136 is secured to a hoist drum or winch (not visible in FIG. 1) fixed to the chassis 106. The hoist cable 136 extends, from the first end, along the length of the boom 110, over a first sheave 138 disposed at the second end 114 of the boom 110, through an attachment mechanism including a second sheave 140 on the dipper 124, and to a second end fixed at a location proximate the first sheave 138. In operation, the hoist drum or winch selectively winds in or lets out the hoist cable 136 to raise or lower the dipper 124, respectively. As will be appreciated, as a result of an attachment at the first mounting structure 130 and/or an attachment at the second mounting structure 132, the dipper 124 is secured relative to the dipper handle 120 as the dipper 124 is raised and lowered via the hoist cable 136.

FIG. 1 also shows a hydraulic crowd control 142 cooperating with the dipper handle 120. The hydraulic crowd control 142 may include a double-acting hydraulic actuator that generally includes a cylindrical housing and a piston moveable relative to the cylindrical housing. For example, the cylindrical housing may be fixed to the saddle block 122 and the piston may be fixed to the dipper handle 120. As noted above, the dipper handle 120 slides relative to the saddle block 122. In this arrangement, as the piston is extended from the cylindrical housing, e.g., from a retracted position to an extended position, the dipper handle 120 is similarly moved to an extended position, in which the dipper 124 is spaced further from the cabin 102. Conversely, as the piston is retracted into the cylindrical housing, the dipper handle is returned toward a retracted position, in which the dipper 124 is relatively closer to the cabin 102. As will be appreciated, the arrangement shown in the Figures and the example just described are for example only.

Aspects of this disclosure may also be applicable to industrial machines that include other than a hydraulic crowd control, such as but not limited to, rack and pinion arrangements, as will be appreciated with the benefit of this disclosure. In at least one alternative example, the hydraulic crowd control 142 may be replaced with a rope crowd mechanism. An example rope crowd mechanism can include a crowd drum, a crowd rope, and a retract rope. For example, the crowd rope may extend from a first end of the dipper shaft, e.g., an end distant from the dipper, extend over one or more sheaves, e.g., located proximate a middle of the dipper handle and disposed to rotate about a shipper shaft, and terminate at the crowd drum. Correspondingly, the retract rope may extend from an end of the dipper handle 120 closest the dipper 124, over the one or more sheaves, and terminate at the crowd drum. As will be appreciated, rotation of the crowd drum in a first direction will cause the dipper handle 120 to extend, and rotation in a second, opposite, direction will cause the dipper handle 120 to retract. Aspects of a rope crowd mechanism are discussed further below with reference to FIG. 6.

Although not illustrated in FIG. 1, the industrial machine 100 also includes a number of additional components to facilitate the operations just described. Without limitation, disposed within the cabin 102 may be one or more user controls for moving the industrial machine 100, e.g., via the track 104 and/or the turntable 108, for raising and lowering the dipper 124, for opening the bottom 128 of the dipper 124, for extending and retracting the dipper handle 120, or the like. The industrial machine 100 can also include one or more control systems, controllers, computing systems, or the like for controlling aspects of the industrial machine, e.g., based on an operator input. The industrial machine 100 can also include one or more power sources, such as one or more hydraulic power sources, one or more engines, one or more motors, one or more electrical supplies, one or more batteries, or the like, to facilitate movement of the components of the industrial machine 100, as described herein.

Figure 2:
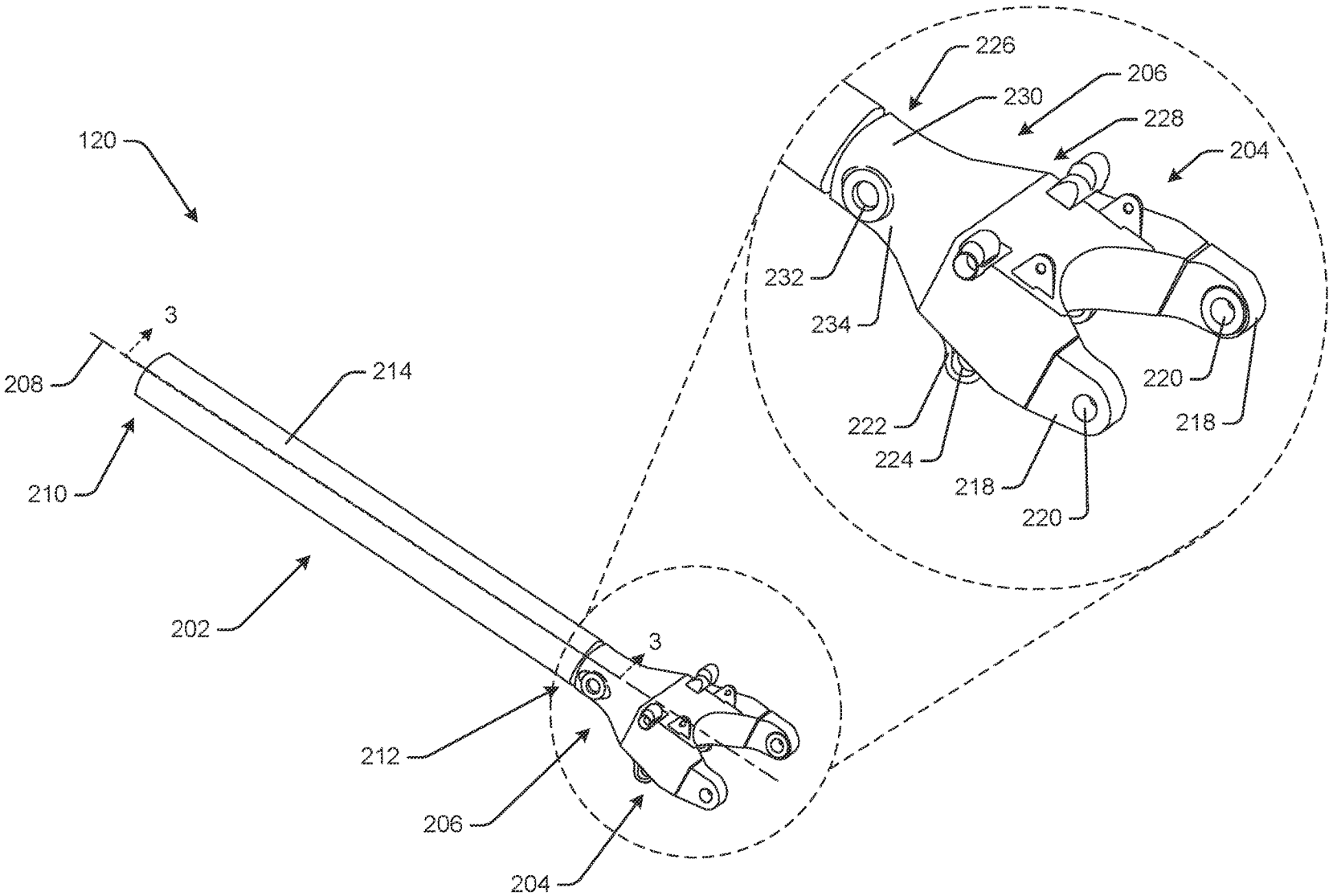
FIG. 2 includes a perspective view of a dipper handle for use with the industrial machine of FIG. 1 and a magnified view of an end of the dipper handle, in accordance with aspects of the present disclosure.
Figure 3:
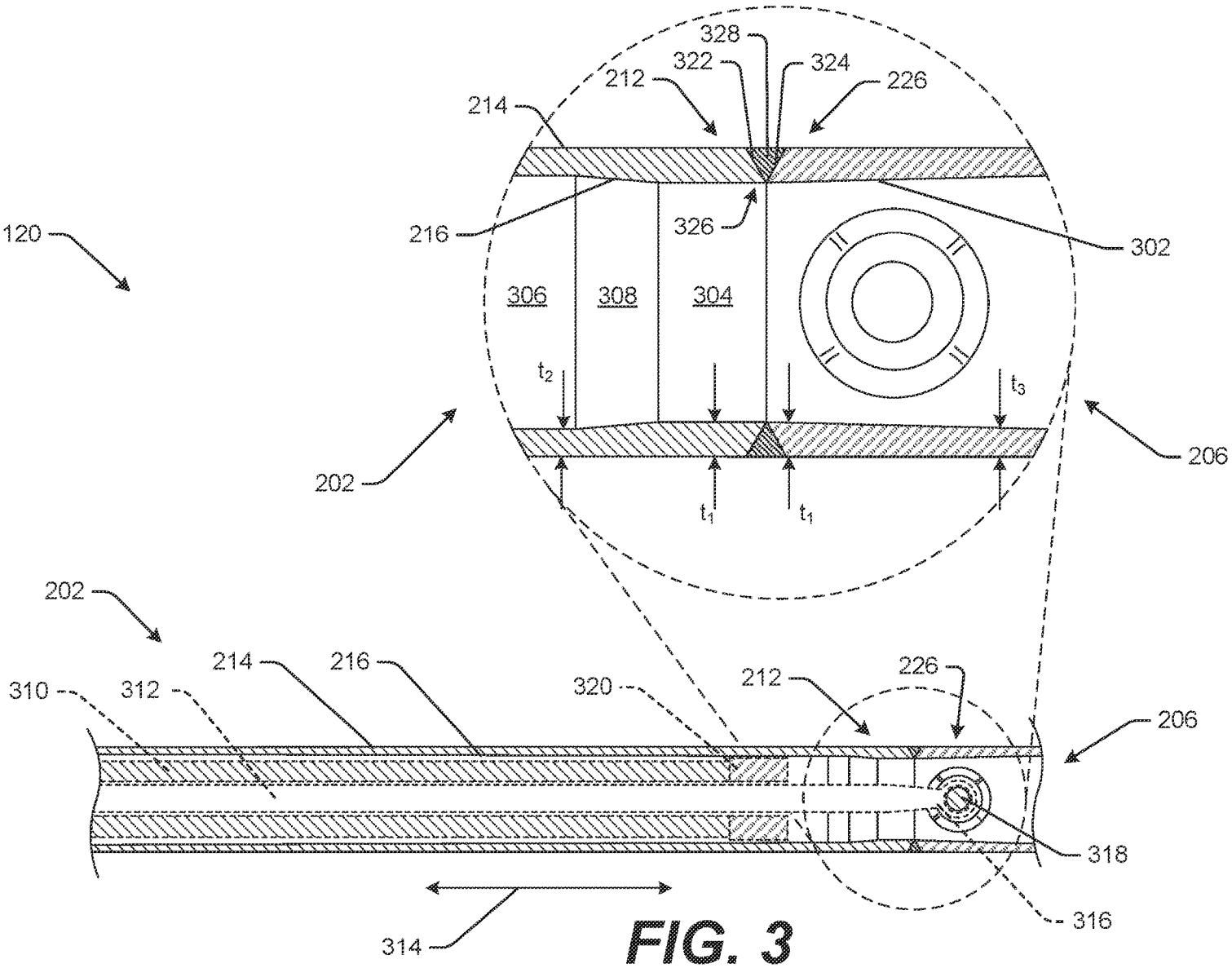
FIG. 3 is a cross-sectional view of a portion of the dipper handle of FIG. 2, taken along the section line 3-3 in FIG. 2.

FIGS. 2 and 3 show aspects of the dipper handle 120 in more detail. Specifically, FIG. 2 includes a perspective view and an enlarged partial perspective view of the dipper handle 120. FIG. 3 includes partial cross-sectional views taken along section line 3-3 in FIG. 2.

In more detail, FIG. 2 shows that the dipper handle 120 generally includes a dipper tube 202, a dipper engagement mechanism 204, and an intermediate member 206. The dipper tube 202 is an elongate tube extending generally along an axis 208 between a first end 210 and a second end 212. An outer surface 214 of the dipper tube 202 is substantially cylindrical. In some implementations, the outer surface 214 has a continuous (and predetermined) diameter configured to engage with, and slide relative to, an opening in the saddle block 122, e.g., during extension and retraction of the dipper handle 120 via the crowd control, as described herein. The dipper tube 202 also includes an inner surface 216 (visible in FIG. 3) defining a longitudinal cavity along the axial length of the dipper tube 202. Stated differently, the dipper tube 202 is open along its length, from the first end 210 to the second end 212. As detailed further below in connection with FIG. 3, the inner surface 216 of the dipper tube 202 has a varied contour configured to improve wear life of the dipper handle 120, e.g., by varying the thickness of the sidewall of the dipper tube 202.

The dipper handle 120 also includes the dipper engagement mechanism 204. The dipper engagement mechanism 204 is generally configured to couple the dipper 124 to the dipper handle 120. In the illustrated arrangement, the dipper engagement mechanism 204 includes spaced apart fingers 218 each having an opening 220. The openings 220 are axially aligned and are configured to facilitate attachment of the dipper 124 to the dipper engagement mechanism 204. For instance, each of the openings 220 may align with one or more corresponding openings in the first mounting structure 130 (discussed above) associated with the dipper 124, and pins may be received through the aligned openings to secure the dipper 124 to the dipper engagement mechanism 204 via the first mounting structure 130. In an alternative arrangement, the dipper 124 may have one or more cylindrical protrusions, e.g., posts, pins, or the like, sized and positioned to cooperate with the openings 220 to secure the dipper 124 relative to the dipper engagement mechanism 204. As will be appreciated, in the example configurations just discussed, the dipper 124 may pivot relative to the dipper engagement mechanism 204, e.g., about an axis extending through the openings 220. Of course, other modifications to the dipper engagement mechanism 204 and/or to the first mounting structure 130 may also be made to facilitate the pivoting attachment.

The dipper engagement mechanism 204 also includes additional features. For instance, an underside (in the orientation of FIG. 2) of the dipper engagement mechanism 204 also includes lower mounting features 222, configured as protrusions, each including an opening 224. The lower mounting features 222 are configured for coupling a linkage, e.g., the linkage 134, to the dipper engagement mechanism 204. In turn, the linkage 134 couples to the dipper 124. In examples, the linkage 134 can further control the rotation of the dipper 124 relative to the dipper handle 120. The fingers 218, the openings 220, and the lower mounting features 222 are for example only; the dipper handle 120 can include additional and/or alternative mounting structures and features for securing the dipper handle 120 to the dipper 124.

In some examples, as shown in the enlarged section included in FIG. 2, the fingers 218 may be formed separately from the remainder of the dipper engagement mechanism 204. For instance, inner surfaces of the openings 220 through the fingers 218 may experience wear. By fabricating the fingers 218 as separate parts, e.g., as individual castings, after significant wear, one or both of the fingers 218 can be selectively removed from the dipper engagement mechanism 204 and replaced with new fingers. In examples, the fingers 218 can be welded to the dipper engagement mechanism 204, although mechanical fasteners may also or alternatively be used.

The intermediate member 206 secures the dipper engagement mechanism 204 to the dipper tube 202. In examples, the intermediate member 206 is a cast part that has a generally circular first end 226 that secures to the dipper tube 202 and a contoured, second end 228 (spaced generally along the direction of the axis 208), that secures to the dipper engagement mechanism 204. In examples, an outer surface 230 of the intermediate member 206 proximate the first end 226 generally matches, e.g., in diameter, the outer surface 214 of the dipper tube 202. Similarly, the outer surface 230 of the intermediate member 206 proximate the second end 228 is generally contoured to match that of the dipper engagement mechanism 204. Accordingly, in the illustrated examples, the dipper handle 120 has a generally continuous outer surface, despite being fabricated from a number of different parts.

Figure 4:
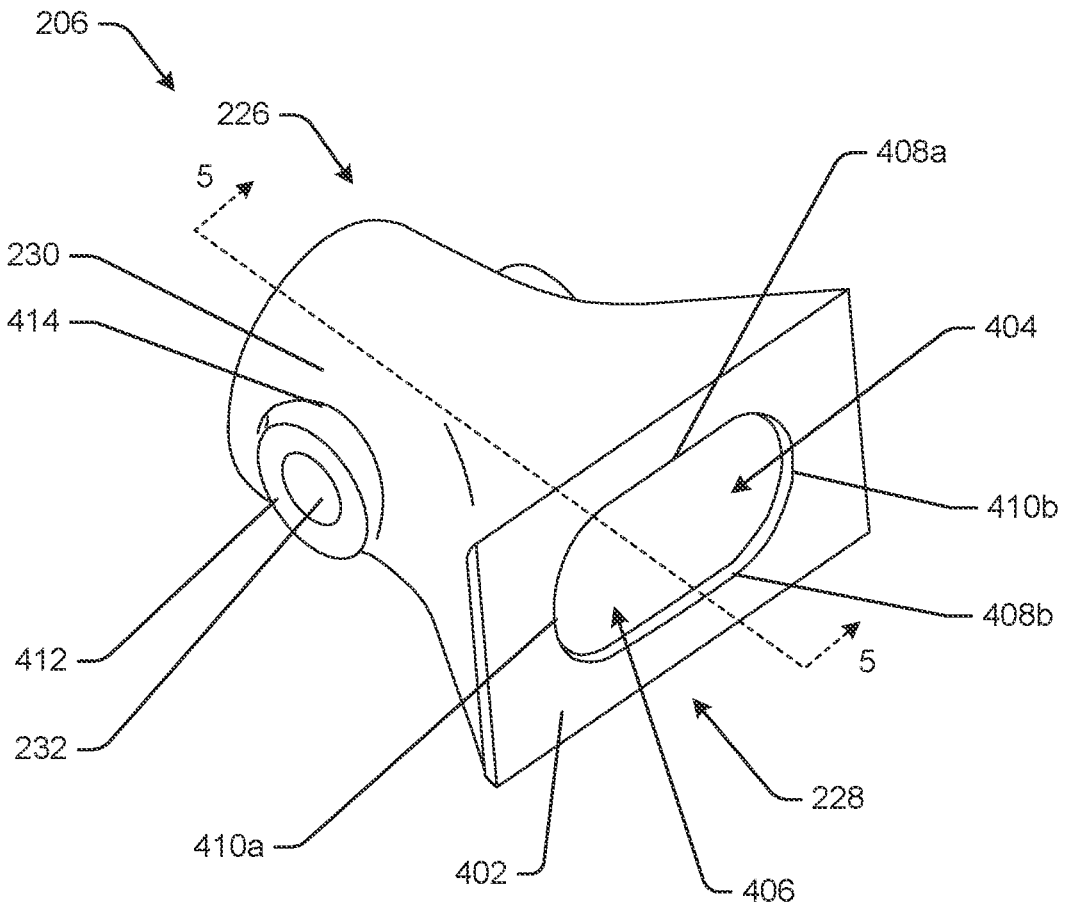
FIG. 4 is a perspective view of an intermediate member of the dipper handle of FIG. 2, in accordance with an example of the present disclosure.
Figure 5:
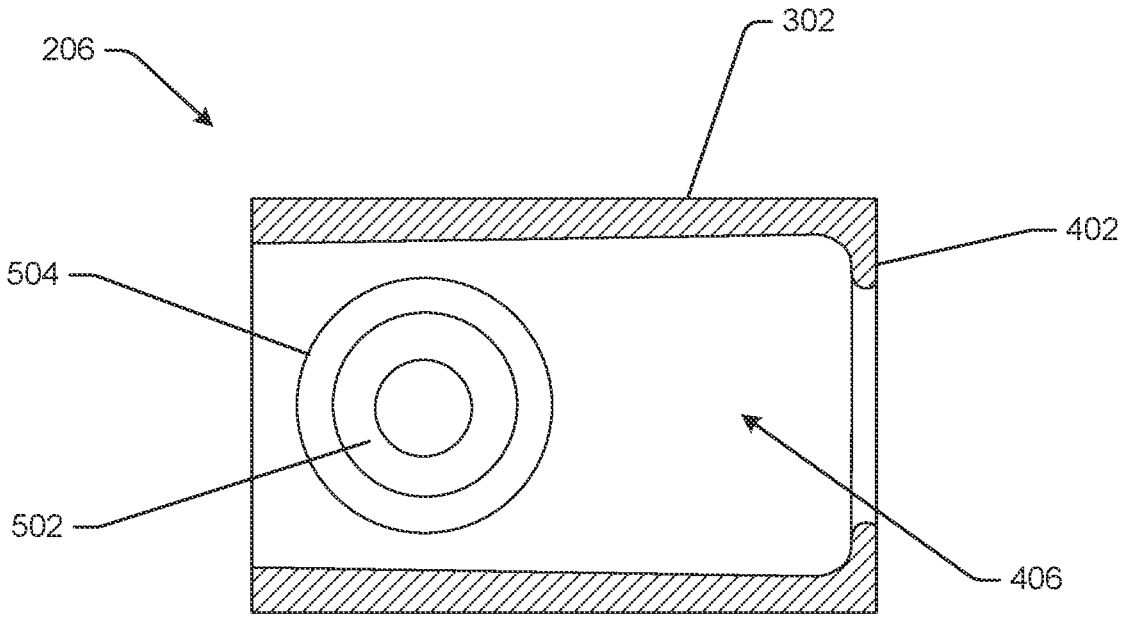
FIG. 5 is a cross-sectional view of the intermediate member of FIG. 4, taken along the section line 5-5 in FIG. 4.

As also illustrated, the intermediate member 206 includes aligned openings 232 formed through lateral sides 234 thereof (Only one of the openings 232 and one of the lateral sides 234 are visible in FIG. 2.) As best shown in FIGS. 3, 4, and 5, the intermediate member 206 defines a hollow interior cavity extending between the openings 232, and that interior cavity extends longitudinally from the first end 226 of the intermediate member 206 to the second end 228 of the intermediate member 206. As discussed further below in connection with FIG. 3, the aligned openings 232 may be used to secure a portion of a piston or ram associated with a hydraulic crowd control, like the crowd control 142. The attachment at the intermediate member 206 facilitates extension and retraction of the dipper handle 120. FIGS. 4 and 5 show the intermediate member 206 in more detail, and additional aspects of the intermediate member 206 are discussed in connection with a description of those figures, below.

FIG. 3 includes cross-sectional views of the dipper handle 120, taken along section line 3-3 in FIG. 2. Additional aspects of the dipper handle 120 will be described with reference to FIG. 3. As noted above, the second end 212 of the dipper tube 202 is coupled to the first end 226 of the intermediate member 206. Details of this coupling are illustrated in FIG. 3. More specifically, as shown in FIG. 3 and as discussed above, the outer surface 214 of the dipper tube 202 is substantially cylindrical, with a substantially constant diameter. Similarly, the outer surface 230 of the intermediate member 206 at the first end 226 of the intermediate member 206 generally matches this outer surface diameter. As also shown in FIG. 3, the inner surface 216 of the dipper tube 202 proximate the second end 212 of the dipper tube 202 generally corresponds in size with an inner surface 302 proximate the first end 226 of the intermediate member 206. For example, the inner surface 216 of the dipper tube 202 proximate the second end 212 and the inner surface 302 of the intermediate member 206 proximate the first end 226 may have a same diameter at a coupling of the dipper tube 202 and the intermediate member 206.

However, in aspects of this disclosure, the inner surface 216 of the dipper tube 202 does not define a constant diameter along the entire axial length of the dipper tube 202. Instead, as shown in FIG. 3, the inner surface 216 is contoured or variable along the axial length of the dipper tube 202. More specifically, the inner surface 216 is contoured such that a thickness of the dipper tube 202 is greater proximate the second end 212 than at positions spaced from the second end 212. As illustrated, the inner surface 216 includes a first section 304 immediately proximate the second end 212 of the dipper tube 202, a second section 306 spaced from the first section 304 and having a larger internal diameter than the first section 304, and a transition section 308 providing a transition between the relatively smaller internal diameter of the first section 304 and the relatively larger internal diameter of the second section 306. Although FIG. 3 shows only a portion of the dipper tube 202, the second section 306 of the inner surface may continue to the first end 210 of the dipper tube 202.

Because the outer surface 214 of the dipper tube 202 has a relatively constant diameter, the dipper tube 202 has a varied wall thickness comprising a relatively thicker wall associated with the first section 304 of the inner surface 216, a relatively thinner wall thickness associated with the second section 306 of the inner surface 216, and a varying thickness along the transition section 308. In the illustrated example, the wall thickness associated with the first section 304 is shown as a first thickness, $t_1$ and the wall thickness associated with the second section 306 is shown as a second thickness, $t_2$. As noted, the first thickness may be generally constant at a portion of the axial length of the dipper tube 202 associated with the first section 304 of the inner surface 216, and the second thickness may be generally constant at a portion of the axial length of the dipper tube 202 associated with the second section 306 of the inner surface 216. In some examples, the first thickness, $t_1$, may be on the order of about 10% to about 30% greater than the second thickness, $t_2$. In one non-limiting example, the first thickness, $t_1$, may be about 125 mm and the second thickness, $t_2$, may be about 100 mm.

The inner surface 302 of the intermediate member 206 may also have a varied diameter, e.g., along an axial dimension parallel to the axis 208. As shown, a thickness of the intermediate member 206 may be thickest proximate the coupling of the intermediate member 206 to the dipper tube 202 with the thickness reducing at (axial) distances therefrom. More specifically, FIG. 3 shows that a thickness of a sidewall of the intermediate member 206 proximate the first end 226 is substantially equal to the first thickness, $t_1$, and the inner surface 302 tapers substantially continuously along the axial direction, with a third thickness, $t_3$, being specifically shown in FIG. 3. Thus, the inner surface 302 may provide a constantly varying thickness for the sidewall of the intermediate member 206, whereas the inner surface 216 of the dipper tube results in two sections of substantially constant, different, diameters, separated by the transitional section 308.

In examples, the varied wall thicknesses of the dipper tube 202 and the intermediate member 206 just described provide an improved dipper handle with improved wear resistance, while not hindering functionality in conventional systems. For example, FIG. 3 also illustrates a portion of a crowd control, which may be the hydraulic crowd control 142. More specifically, FIG. 3 shows, in dashed lines, a cylinder 310 disposed in the dipper tube 202. A ram or piston 312 is disposed partially in the cylinder 310 and is configured to extend and retract relative to cylinder 310, e.g., generally in the direction of arrow 314. A distal end 316 of the piston 312 is secured to the intermediate member 206, e.g., via a pin 318 passing through the lateral openings 232. Bushings 320 or similar features are provided proximate a terminal end of the cylinder 310 to facilitate movement, e.g., sliding, of the dipper tube 202 relative to the cylinder 310. More specifically, FIG. 3 shows a retracted or nearly retracted position of the crowd control. As will be appreciated, as the piston 312 is extended, e.g., moved to the right along the direction of arrow 314 in FIG. 3, the cylinder 310 remains substantially stationary. Thus the extension of the piston 312 causes the dipper tube 202 to move along with the extending piston 312, via the connection at the pin 318. Here, the dashed lines are used to indicate that the cylinder arrangement is for example only. As discussed below in connection with FIG. 6 and elsewhere herein, the dipper handle 120 can be used with any conventional crowd control mechanisms.

Because the inner surface 216 of the dipper tube 202 must move relative to the cylinder 310, e.g., by sliding engagement at the bushings 320, conventional dipper tubes have had inner surfaces with a constant diameter, e.g., to avoid interference at the bushings 320. As noted above, conventional dipper tubes also have a constant outer diameter to facilitate sliding of the dipper tube relative to the saddle block 122. In the present disclosure, the second section 306 of the inner surface 216 of the dipper tube 202 extends over an axial length of the dipper tube 202 that is equal to or longer than a length of the cylinder 310 disposed in the dipper tube 202. Thus, the first section 304 of the inner surface 216, which has a smaller diameter than a diameter at the second section 306, is axially spaced from portions of the inner surface 216 with which outer surfaces of the crowd control will come into contact. Stated differently, the first section 304 of the inner surface 216 of the dipper tube 202 comprises a relatively small portion of the dipper tube 202 that is located proximate the second end 212 whereas the second section 306 of the inner surface 216 is a much longer portion that accommodates the stroke of the crowd control mechanism. In some examples, the second section 306 of the inner surface 216 may comprise on the order of from about 90% to about 95% of the axial length of the dipper tube 202, and the first section 304 may comprise less than about 10% of the axial length of the dipper tube 202. In one non-limiting example, the dipper tube may be on the order of about 9 meters in length and the second section 306 may comprise about 8.5 meters. In this example, the first section 304 may comprise about 0.3 meters. As will be appreciated, the lengths of the sections of the inner surface 216 may vary. For instance, in some examples the transition section 308 may be negligible, e.g., a radial face or wall may separate the first section 304 from the second section 306. In other configurations, the first section 304 may be omitted, or may be incorporated into the transition section 308. For example, the inner surface 216 of the dipper tube 202 may continuously vary in diameter from the termination of the second section 306 to the second end 212 of the dipper tube 202. However, in configurations according to this disclosure, the second section 306 is sufficiently long to accommodate a desired stroke of the hydraulic crowd control.

As also illustrated in the example of FIG. 3, the second end 212 of the dipper tube 202 includes a first beveled edge 322 and the first end 226 of the intermediate member 206 includes a second beveled edge 324. For instance, when the dipper tube 202 and the intermediate member 206 are aligned as shown in FIG. 3, the first beveled edge 322 and the second beveled edge 324 cooperate to provide a groove 326. The groove 326 provides a location at which a weld 328 can be formed, to secure the dipper tube 202 to the intermediate member 206. Because of the increased wall thicknesses proximate the first beveled edge 324 and the second beveled edge 326, e.g., resulting from the contoured inner surfaces 216, 302, the weld 328 is sufficiently strong to couple the dipper tube 202 to the intermediate member 206 while resisting fatigue common in conventional arrangements. Moreover, the use of the beveled edges 324, 326 may obviate the need to create a weld on the inner surfaces 216, 302. In conventional dipper handles, a welder or other craftsman would have to access the inner surfaces 216, 302, e.g., through the length of the dipper tube 202 and/or via the cavity in the intermediate member. Advantageously, the contoured inner surfaces 216, 302 of the subject disclosure promote formation of the groove 326 having sufficient depth that the weld 328 will provide a stronger coupling than in conventional dipper handle assemblies.

In some examples, as noted above, the contoured surfaces can provide an increased wall thickness, proximate the joined ends of the dipper tube 202 and the intermediate member 206. The thickness of the intermediate member 206 proximate the first end 226 is substantially the same as the thickness of the dipper tube 202 proximate the second end 212, e.g., the first thickness $t_1$.

The contoured inner surfaces of the present disclosure improve strength, and therefore life expectancy. For instance, the inventors have discovered, through conventional modeling and stress determination techniques, that the contoured inner surfaces 216, 302 promote an increased weld life of from about 1.7 to about 1.9 times, thereby increasing overall part life for the dipper handle 120. This increased part life results in reduced downtime and increased productivity. Moreover, these advantages are achieved without hindering performance of the dipper handle 120, e.g., in a conventional rope shovel. For example, the dipper handle 120 according to this disclosure can be used as a replacement part in rope shovels currently in use, without requiring expensive and/or time-consuming redesigns of other aspects of the rope shovel.

Figure 6:
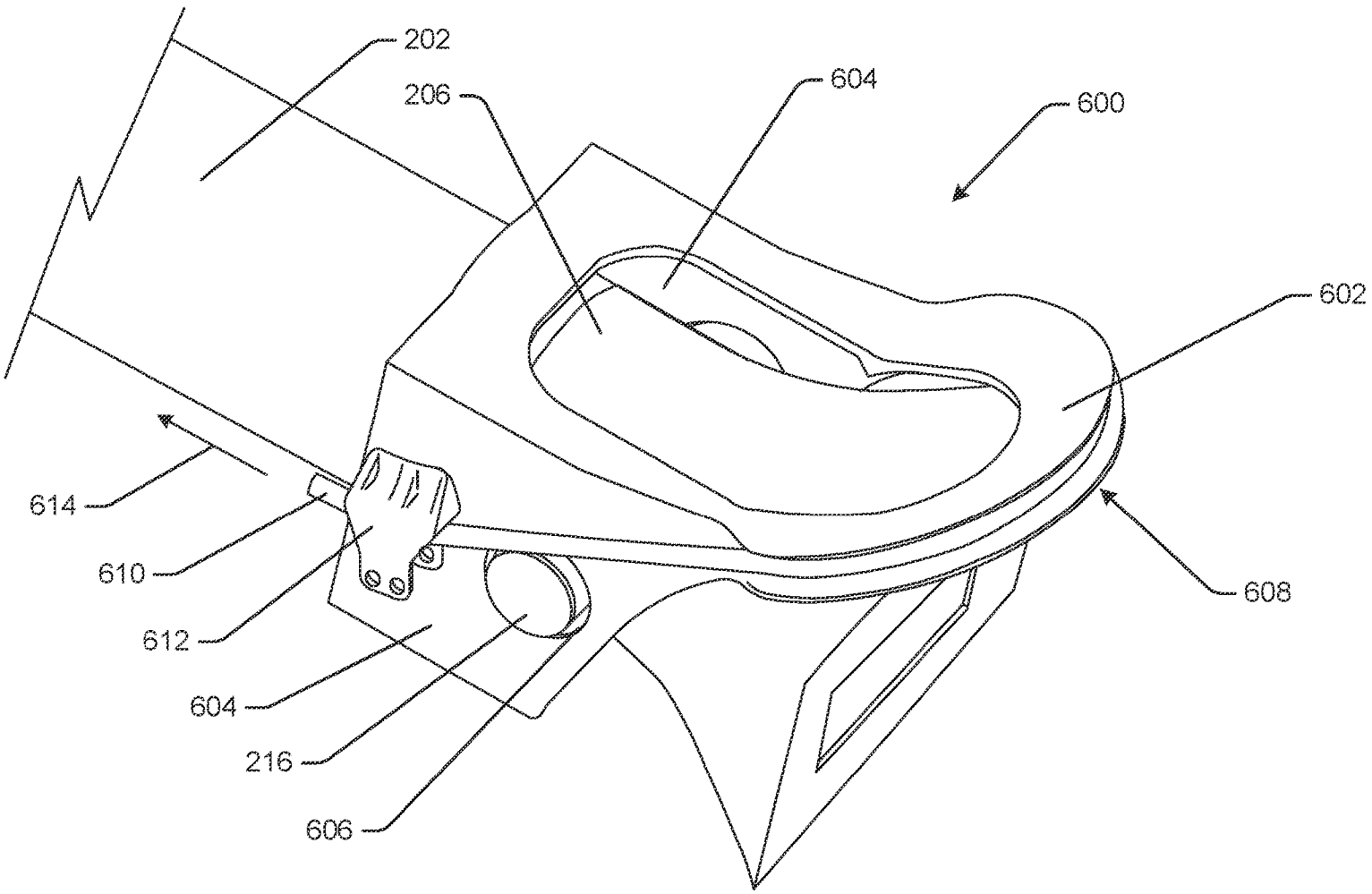
FIG. 6 is a partial perspective view of aspects of the dipper handle of FIG. 2 used with a rope crowd control mechanism, in accordance with an example of the present disclosure.

Although the foregoing embodiments are generally described in connection with a hydraulic crowd control mechanism, e.g., including the cylinder 310, other types of crowd control also may be used. For example, as discussed above in connection with FIG. 1, a rope crowd can replace the hydraulic crowd control. In examples, modifications to the intermediate member 206 and/or to the dipper engagement mechanism 204 may be made when different crowd control mechanisms are used. Without limitation, when a rope crowd is used, the dipper handle may be configured to include features other than or in addition to the axial openings 232. Without limitation, one or more rope engagement features, e.g., for cooperating with the retract rope and/or the crowd rope may be provided on the dipper tube 202, the dipper engagement mechanism 204, and/or the intermediate member 206. Portions of an example rope crowd are shown in FIG. 6 and described further below.

The dipper handle 120 also has other improvements over conventional designs. For instance, FIGS. 4 and 5 show additional aspects of the intermediate member 206, which also provide improvements over conventional designs. More specifically, FIG. 4 is a perspective view of the intermediate member 206 and FIG. 5 is a cross-section of the intermediate member 206 taken along the section line 5-5 in FIG. 4. In FIGS. 4 and 5, the same reference numerals introduced above in FIGS. 1-3 are used to refer to the same features.

FIG. 4 demonstrates that the outer surface 230 of the intermediate member 206 is substantially cylindrical proximate the first end 226 and transitions to a substantially rectangular shape at the second end 228. More specifically, the second end 228 includes an end surface 402 and an opening 404 formed through the end surface 402. In this example, the end surface 402 is substantially planar and has a rectangular perimeter. For instance, the end surface 402 may be formed to contact a corresponding surface on the dipper engagement mechanism 204. The opening 404 provides access to an inner cavity 406 of the intermediate member 206. In examples, the opening 404 is generally slot-shaped, including opposite, substantially parallel sides 408*a*, 408*b*, extending between rounded ends 410*a*, 410*b*. In examples, the opening 404 is sized to provide an overall weight reduction of the intermediate member 206. For example, the material removed from the surface 402 by the opening 404 can offset substantially all of the weight added by virtue of the thickened sidewall, discussed above and shown in more detail in FIGS. 3 and 5. Although illustrated as being generally slot-shaped, the opening 404 can have other shapes, sizes, or the like.

FIG. 4 also shows bosses 412 in detail. Specifically, the bosses 412 extend from the lateral sides 234 of the outer surface 230 proximate the first end 226, and the axial openings 232 extend through the bosses. As discussed above, the axial openings 232 may be used to couple a crowd control mechanism to the dipper handle 120. Also shown in FIG. 4, a radius 414 or fillet is formed between the bosses 412 and the outer surface 230. In examples, the radius 414 can be on the order of about 60 millimeters.

FIG. 5 is a cross-section of the intermediate member 206 taken along the section line 505 in FIG. 4. FIG. 5 shows the inner surface 302 in more detail. For example, the inner surface 302 continues to taper, relative to the outer surface 230 of the intermediate member to a position at the surface 402. As also shown in FIG. 5, bosses 502 may be formed on the inner surface 302, with the axial openings 232 extending therethrough. As with the bosses 412, the bosses 502 may provide increased strength proximate the axial openings, e.g., to facilitate a reliable coupling of the intermediate member 206 to the hydraulic crowd control, when used. Fillets 504 may also be provided at a transition between the bosses 502 and the inner surface 302. In examples, the fillets 504 may be increased in radius relative to previous designs, e.g., to further increase strength.

As discussed above, in examples the intermediate member 206 may be a cast part, e.g., cast from steel, alloys, and/or the like. The intermediate member 206 may weigh on the order of about 3800 kg. Thus, in addition to the dipper 124, the dipper handle 120 also supports its own relatively large weight. The techniques and features described herein are capable of reducing fatigue and failure when supporting these large loads.

As noted above, in addition to the improved dipper handle 120, including the intermediate member 206, providing improvements over conventional dipper handles, the dipper handle 120 can also be used with existing system, regardless of a type of crowd control mechanism implemented on the industrial machine 100. In the example of FIGS. 1 and 3, the crowd control is hydraulic, e.g., including the cylinder 310 disposed in the dipper tube 202. FIG. 6 shows the dipper tube 202 and the intermediate member 206, as well as aspects of a conventional rope control mechanism. Specifically, FIG. 6 shows a rope spreader 600 coupled to the intermediate member 206.

The rope spreader 600 includes a sheaved portion 602 and lateral sides 604. As illustrated, the lateral sides 604 are spaced to receive intermediate portion 206 therebetween. More specifically, the lateral sides 604 include openings 606 that can be axially aligned with the axial openings 232 (not visible in FIG. 6) in the intermediate member 206. FIG. 6 also shows a pin 608 disposed through the openings 606 (and the axial openings 232) to retain the rope spreader 600 on the intermediate member 206. As will be appreciated, according to this arrangement, the rope spreader 600 is coupled to the intermediate member 206 using the same axial openings 232 as the hydraulic crowd control mechanism, discussed above.

The sheaved portion 602 defines an arcuate groove 608. A rope 610, e.g., a retract rope, extends over the sheaved portion 602, in the arcuate groove 608. Lateral guides 612 also are shown, disposed on the lateral sides 604, to further guide the rope 610. Only a portion of the rope 610 is illustrated in FIG. 6. As will be appreciated, and in accordance with conventional arrangements, distal ends of the rope 610 may be connected to a crowd drum. When the crowd drum rotates in a first direction, the rope 610 is wound on the crowd drum, causing the rope 610 to exert a force on the sheaved portion 602 to move the dipper tube 202 and the intermediate member 206 generally along a direction shown by an arrow 614, e.g., to retract the dipper handle 120. A second rope (not shown in the Figures) is similarly disposed proximate the first end of the dipper tube 202. The second rope is wound about the crowd drum to cause the dipper handle to extend.

As discussed above, the outer diameter of the dipper tube 202 and the outer diameter of the intermediate member 206 are unchanged from conventional dipper handle assemblies. Accordingly, aspects of the rope spreader 600, e.g., spacing between the lateral sides 604, positioning of the openings 606, and the like, need not be modified for use with the dipper handle 120. Thus, the present disclosure provides benefits via the dipper handle 120, including improved life and reduced fracturing, whether the dipper handle 120 is used with the rope crowd control mechanism, the hydraulic crowd control mechanism, and/or other conventional crowd control mechanisms.

INDUSTRIAL APPLICABILITY

The present disclosure provides improved dipper handles for use with conventional mining machines, such as rope shovels. The dipper handles according to this disclosure provide increased wear life over conventional dipper handles, resulting in less downtime to replace worn or broken dipper handles. Moreover, despite the increased wear life, the dipper handles described herein may be used in conventional machines, e.g., as replacement parts when conventional parts are to be replaced.

According to some implementations, a dipper handle 120 includes a dipper tube 202, a dipper engagement mechanism 204, and an intermediate member 206 fixed to the dipper tube 202 and the dipper engagement mechanism 204. The dipper engagement mechanism 204 is configured to attach to a dipper 124. The dipper tube 202 has a contoured inner surface 216 that provides a variable thickness sidewall along a portion of the axial length of the dipper tube 202. For example, a first section 304 of the dipper tube 202, proximate a connection point of the dipper tube 202 to the intermediate member 206 has a first thickness $t_1$. A second section 306 of the dipper tube 202, spaced from the connection point, has a second thickness $t_2$ less than the first thickness $t_1$. The second section 306 may accommodate a stroke of a cylinder associated with a hydraulic crowd control, whereas the increased thickness at the first section 304 provides an improved coupling of the dipper tube 202 to the intermediate member 206.

While aspects of the present disclosure have been particularly shown and described with reference to the examples above, it will be understood by those skilled in the art that various additional implementations may be contemplated by the modification of the disclosed machines, systems and methods without departing from the spirit and scope of what is disclosed. Such implementations should be understood to fall within the scope of the present disclosure as determined based upon the claims and any equivalents thereof.

What is claimed is:

1. A dipper handle comprising:

a dipper engagement member configured to selectively couple to a dipper;

a dipper tube comprising a sidewall extending between a first end of the dipper tube and a second end of the dipper tube, the sidewall of the dipper tube having a first thickness proximate the first end of the dipper tube and having a second thickness, greater than the first thickness, proximate the second end of the dipper tube; and an intermediate member disposed between the dipper engagement member and the dipper tube, a first end of the intermediate member being configured for securement to the second end of the dipper tube.

2. The dipper handle of claim 1, wherein the first end of the intermediate member has a wall thickness substantially the same as the second thickness.

3. The dipper handle of claim 1, further comprising:

a weld securing the second end of the dipper tube to the first end of the intermediate member.

4. The dipper handle of claim 3, further comprising a first beveled edge on the second end of the dipper tube and a second beveled edge on the first end of the intermediate member.

5. The dipper handle of claim 4, wherein:

the first beveled edge and the second beveled edge cooperate to form a groove, wherein the weld is disposed in the groove.

6. The dipper handle of claim 1, wherein the dipper tube has a substantially cylindrical outer dipper tube surface and an inner dipper tube surface spaced from the outer dipper tube surface by the first thickness proximate the first end of the dipper tube and the second thickness proximate the second end of the dipper tube.

7. The dipper handle of claim 6, wherein the inner dipper tube surface has a substantially constant first diameter along a first portion of an axial length of the dipper tube and the inner dipper tube surface has a substantially constant second diameter, smaller than the first diameter, along a second portion of the axial length of the dipper tube.

8. The dipper handle of claim 7, wherein the first portion of the axial length is at least about 90% of the axial length of the dipper tube.

9. The dipper handle of claim 7, wherein the inner dipper tube surface further comprises a transitional portion having a variable diameter, the transitional portion extending between the first portion of the axial length of the dipper tube and the second portion of the axial length of the dipper.

10. The dipper handle of claim 1, wherein the second thickness is between about 20% and about 30% greater than the first thickness.

11. The dipper handle of claim 1, wherein the intermediate member has an inner surface and an outer surface tapered relative to the inner surface such that a wall thickness of the intermediate member proximate the first end of the intermediate member is thicker than the wall thickness at a distance spaced from the first end.

12. An industrial machine comprising:

a base;

a boom extending from the base;

a crowd control mechanism movable between a retracted position and an extended position;

a dipper handle coupled to the crowd control mechanism and movable by the crowd control mechanism, the dipper handle comprising:

a dipper tube comprising a sidewall extending along an axial length between a first end of the dipper tube and a second end of the dipper tube, the sidewall of the dipper tube having a first thickness along a first portion of the axial length proximate the first end of the dipper tube and having a second thickness, greater than the first thickness, along a second portion of the axial length proximate the second end of the dipper tube, an intermediate member coupled to the second end of the dipper tube, and a dipper engagement member coupled to the intermediate member; and a dipper attached to the dipper engagement member.

13. The industrial machine of claim 12, wherein:

the crowd control mechanism comprises a hydraulic crowd control mechanism including a hydraulic cylinder coupled to the boom; and at least a portion of the hydraulic cylinder is disposed in the dipper tube and being spaced in an axial direction from the sidewall of the dipper tube having the second thickness.

14. The industrial machine of claim 12, wherein the dipper tube has a substantially cylindrical outer dipper tube surface and an inner dipper tube surface spaced from the outer dipper tube surface by the first thickness proximate the first end of the dipper tube and by the second thickness proximate the second end of the dipper tube.

15. The industrial machine of claim 14, wherein:

the inner dipper tube surface has a substantially constant first diameter along a first portion of an axial length of the dipper tube;

the inner dipper tube surface has a substantially constant second diameter, smaller than the first diameter, along a second portion of the axial length of the dipper tube; and the first diameter allows a sliding engagement with the at least the portion of the hydraulic cylinder disposed in the dipper tube.

16. The industrial machine of claim 15, wherein the inner dipper tube surface further comprises a transitional portion having a variable diameter, the transitional portion extending between the first portion of the axial length of the dipper tube and the second portion of the axial length of the dipper.

17. A dipper handle comprising:

a dipper tube having a substantially cylindrical outer dipper tube surface and a contoured inner dipper tube surface spaced from the outer dipper tube surface by a first thickness proximate a first end of the dipper tube and by a second thickness, greater than the first thickness, proximate a second end of the dipper tube;

an intermediate member having a first intermediate member end fixed to the second end of the dipper tube; and a dipper engagement member coupled to the intermediate member and configured to couple to a dipper.

18. The dipper handle of claim 17, wherein:

the intermediate member has an outer intermediate member surface spaced from an inner intermediate member surface by an intermediate member thickness, and the intermediate member thickness is greater proximate the first intermediate member end that at a position spaced from the first intermediate member.

19. The dipper handle of claim 18, wherein the intermediate member thickness proximate the first intermediate member end is substantially the same as the second thickness.

20. The dipper handle of claim 19, wherein:

the second end of the dipper tube comprises a first beveled edge, the first intermediate member end comprises a second beveled edge, and the first beveled edge and the second beveled edge form a groove.

* * * * *